US012350545B2

(12) United States Patent
Sun

(10) Patent No.: US 12,350,545 B2
(45) Date of Patent: Jul. 8, 2025

(54) DUMBBELL BENCH

(71) Applicant: Hui Sun, Jiangsu (CN)

(72) Inventor: Hui Sun, Jiangsu (CN)

( * ) Notice: Subject to any disclaimer, the term of this patent is extended or adjusted under 35 U.S.C. 154(b) by 172 days.

(21) Appl. No.: 18/361,034

(22) Filed: Jul. 28, 2023

(65) Prior Publication Data

US 2025/0025740 A1 Jan. 23, 2025

(30) Foreign Application Priority Data

Jul. 18, 2023 (CN) ..... 202321887165.6

(51) Int. Cl.
*A63B 21/00* (2006.01)

(52) U.S. Cl.
CPC ..... *A63B 21/4029* (2015.10); *A63B 2210/50* (2013.01); *A63B 2225/093* (2013.01)

(58) Field of Classification Search
CPC ..... A63B 21/0726; A63B 21/4029; A63B 71/0036; A63B 2210/50; A63B 2225/09; A63B 2225/093
See application file for complete search history.

(56) References Cited

U.S. PATENT DOCUMENTS

| | | | | |
|---|---|---|---|---|
| 7,654,944 | B1 | 2/2010 | Liu | |
| 7,731,639 | B1 | 6/2010 | Shifferaw | |
| D933,762 | S * | 10/2021 | Wang | D21/687 |
| D943,688 | S * | 2/2022 | Lu | D21/686 |
| D944,345 | S * | 2/2022 | Li | D21/686 |
| 11,413,492 | B2 | 8/2022 | Baker et al. | |
| 11,465,010 | B2 * | 10/2022 | Ho | A63B 21/4029 |
| D975,217 | S * | 1/2023 | Feng | D21/690 |
| D986,360 | S * | 5/2023 | Dai | D21/686 |
| D1,007,623 | S * | 12/2023 | Hu | D21/690 |
| D1,010,034 | S * | 1/2024 | Lv | D21/690 |
| D1,013,072 | S * | 1/2024 | Chen | D21/690 |
| D1,025,251 | S * | 4/2024 | Chen | D21/687 |
| D1,036,584 | S * | 7/2024 | Liu | D21/686 |
| D1,065,378 | S * | 3/2025 | Xia | D21/690 |
| 2006/0035772 | A1 * | 2/2006 | Golesh | A63B 21/4029 482/142 |
| 2018/0369633 | A1 * | 12/2018 | Baker | A63B 21/4029 |
| 2022/0219037 | A1 | 7/2022 | Ho | |
| 2022/0410140 | A1 * | 12/2022 | Ho | B01L 3/0275 |

FOREIGN PATENT DOCUMENTS

CN 204219687 U * 3/2015

OTHER PUBLICATIONS

English translation of CN 204219687 U. (Year: 2015).*

* cited by examiner

*Primary Examiner* — Joshua Lee

(57) ABSTRACT

The present disclosure provides a dumbbell bench, comprising a front leg part and a rear leg part, wherein the front leg part is hinged with the rear leg part in a limited manner, the front leg part is provided with a cushion part and an elbow pad part in a limited hinging manner, and the cushion part and the elbow pad part may rotate relative to the front leg part at a limited angle, respectively; and the rear leg part is provided with a backrest part in a limited hinging manner, and the backrest part may rotate relative to the rear leg part at a limited angle.

11 Claims, 6 Drawing Sheets

B

DUMBBELL BENCH

TECHNICAL FIELD

The present disclosure relates to the field of fitness equipment, in particular to a dumbbell bench.

BACKGROUND

A dumbbell, as indoor fitness equipment, is popular with fitness enthusiasts. In order to get a better training effect, it is a good choice to use a dumbbell bench in doing dumbbell exercises. In an ordinary family environment, the dumbbell bench takes up more space, so that a folding dumbbell bench is highly appreciated. In the current market, the folding dumbbell benches available support sitting and lying posture exercises, but cannot support some specific weightlifting actions due to lack of an elbow pad, including doing dumbbell curl and behind-the-neck press, for which the elbows need to be supported additionally. Some dumbbell benches with the elbow pad have complete functions, but cannot be folded completely. They still take up a large space after being folded, which does not allow for convenient storage. Besides, some dumbbell benches lack a locking function at the folds, and thus may structurally shake during use.

SUMMARY

The present disclosure aims to provide a dumbbell bench, comprising a cushion part, a backrest part and an elbow pad part, which are all foldable, so as to achieve the purpose of volume reduction of the dumbbell bench after being fully folded for convenient storage.

In order to achieve the above purpose, the present disclosure provides the following technical solution:

A dumbbell bench, including a front leg part and a rear leg part, where the front leg part is hinged with the rear leg part in a limited manner, the front leg part is provided with a cushion part and an elbow pad part in a limited hinging manner, and the cushion part and the elbow pad part may rotate relative to the front leg part at a limited angle, respectively; and the rear leg part is provided with a backrest part in a limited hinging manner, and the backrest part may rotate relative to the rear leg part at a limited angle.

Further, the front leg part includes a front leg pipe, one end of the front leg pipe is fixedly connected to a first connecting piece, and the first connecting piece is provided with first connecting holes and second connecting holes penetrating through two sides thereof; the rear leg part includes a rear leg pipe, one end of the rear leg pipe is fixedly connected to a second connecting piece, and the second connecting piece is provided with third connecting holes and fourth connecting holes; a bolt respectively penetrates through the first connecting holes and the third connecting holes to enable hinging between the first connecting piece and the second connecting piece; and a first pin respectively penetrates through the second connecting holes and the fourth connecting holes to enable limited locking between the first connecting piece and the second connecting piece.

Further, the first connecting piece is further fixedly provided with a folding locating rod, a place, corresponding to the folding locating rod, of the second connecting piece is provided with a folding locating slot, and sizes of the folding locating slot and the folding locating rod fit each other; and when the folding locating rod is located in the folding locating slot, the first connecting piece is not capable of rotating upwards relative to the second connecting piece.

Further, the elbow pad part includes an elbow pad, where a first support pipe is fixedly arranged below the elbow pad, and the other end of the first support pipe is hinged with a bottom end of the front leg pipe.

Further, the elbow pad part further includes a second support pipe, one end of the second support pipe is hinged with the first support pipe, and the other end thereof is hinged with a third sliding sleeve; the third sliding sleeve is sleeved on the front leg pipe and is further provided with a third control knob; and when the third control knob is tightened, the third sliding sleeve may be fixed on the front leg pipe to avoid sliding.

Further, one of hinges of two ends of the second support pipe is provided with a second pin.

Further, a leg extension part is hinged on the first support pipe in a limited manner.

Further, the first connecting piece is further fixedly provided with a cushion connecting rod; the cushion part includes a cushion, a bottom part of the cushion is detachably provided with cushion pipes, end parts of the cushion pipes are fixedly provided with cushion rotating casings which are sleeved on the cushion connecting rod, and the cushion pipes are hinged with the cushion connecting rod through the cushion rotating casings.

Further, the second connecting piece is further fixedly provided with a backrest connecting rod; the backrest part includes a backrest, a bottom part of the backrest is detachably provided with backrest pipes, end parts of the backrest pipes are fixedly provided with backrest rotating casings which are sleeved on the backrest connecting rod, and the backrest pipes are hinged with the backrest connecting rod through the backrest rotating casings.

Further, the first support pipe is a telescopic pipe, a telescopic end of the first support pipe is fixedly connected to a bottom part of the elbow pad, and a height of the elbow pad is adjusted with an extension of the telescopic end of the first support pipe.

Further, the other end of the front leg pipe is detachably provided with a front leg-foot pipe, and a bottom end of the elbow pad part is hinged with the front leg-foot pipe.

As can be seen from the analysis, the dumbbell bench disclosed by the present disclosure includes the cushion part, the backrest part and the elbow pad part that are all foldable. The volume of the dumbbell bench after being folded is reduced to facilitate storage, the folding structure is stable and the folding and unfolding processes are convenient and quick.

BRIEF DESCRIPTION OF THE DRAWINGS

The drawings constituting a part of the present application are intended to facilitate further understanding of the present disclosure. The illustrative embodiments of the present disclosure and the description thereof are used for explaining the present disclosure rather than constituting improper limitations to the present disclosure.

Figure 1:
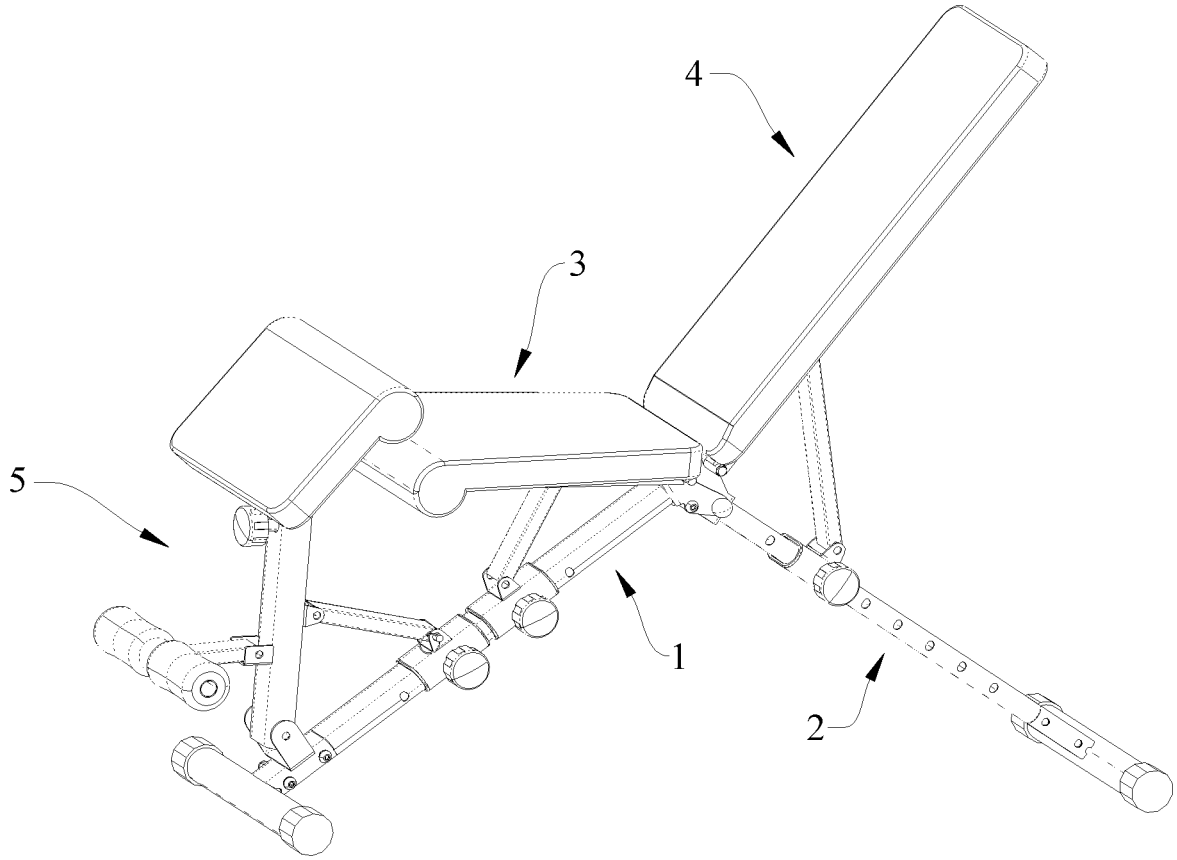
FIG. 1 is a structural schematic diagram of a dumbbell bench in an embodiment.
Figure 2:
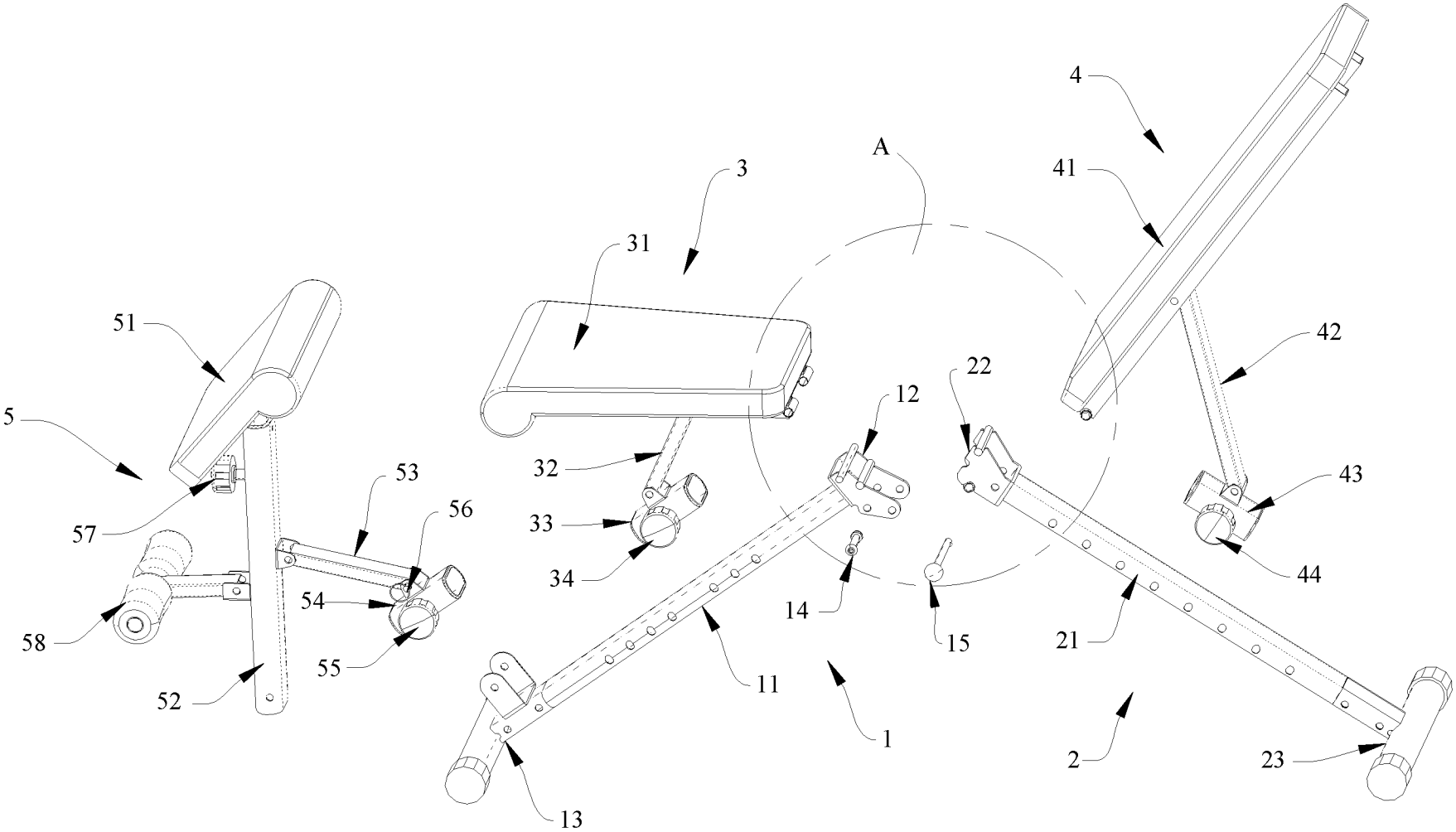
FIG. 2 is a structural schematic exploded view of a dumbbell bench in an embodiment.
Figure 3:
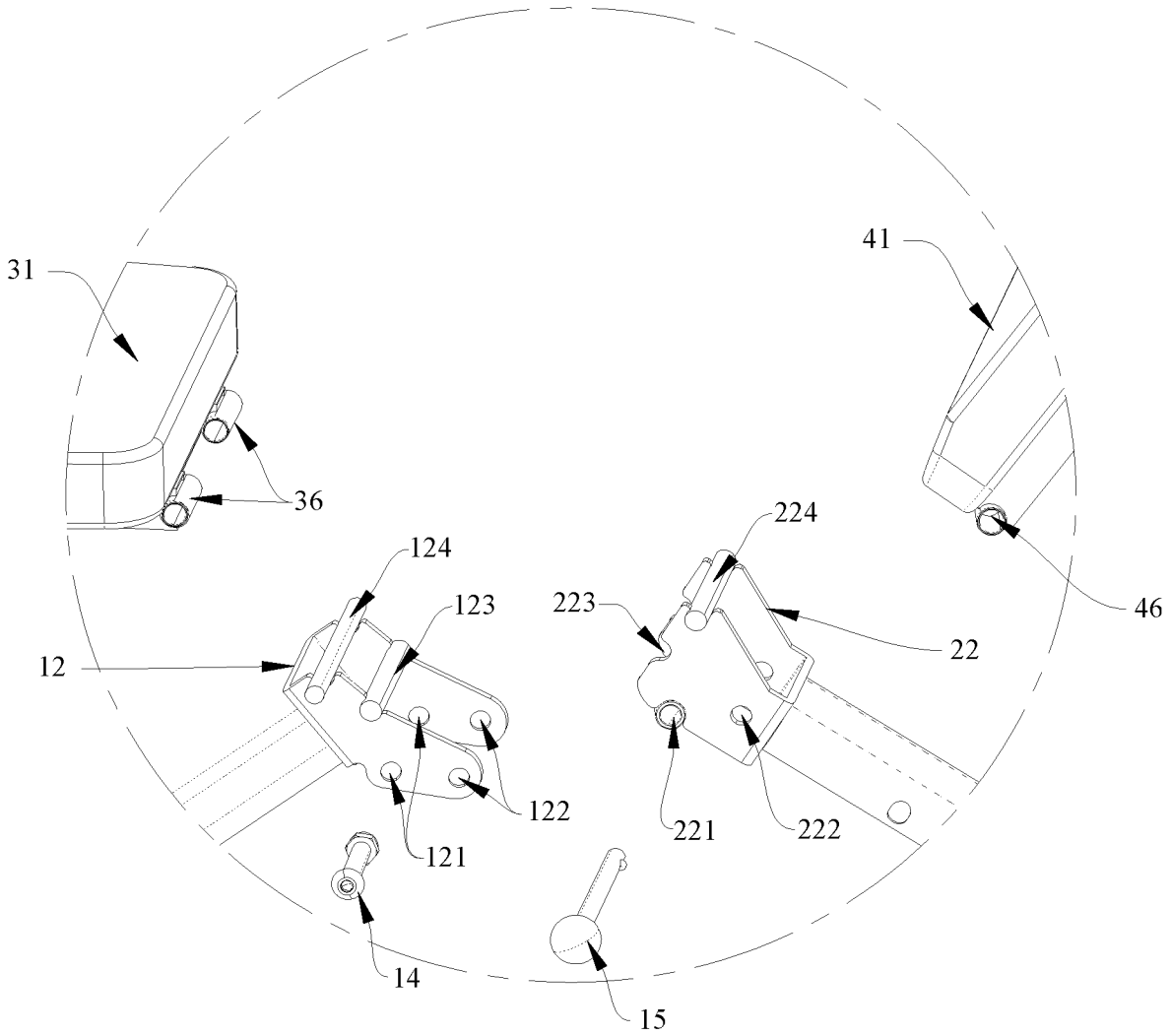
FIG. 3 is a structural enlarged view of a marked part at point A in FIG. 2.

Description of the reference designations in the drawings: 1—front leg part; 11—front leg pipe; 12—first connecting piece; 121—first connecting hole; 122—second connecting hole; 123—folding locating rod; 124—cushion connecting rod; 13—front leg-foot pipe; 14—bolt; 15—first pin; 2—rear leg part; 21—rear leg pipe; 22—second connecting piece; 221—third connecting hole; 222—fourth connecting hole; 223—folding locating slot; 224—backrest connecting rod; 23—rear leg-foot pipe; 3—cushion part; 31—cushion; 32—cushion support pipe; 33—first sliding sleeve; 34—first control knob; 4—backrest part; 41—backrest; 42—backrest support pipe; 43—second sliding sleeve; 44—second control knob; 5—elbow pad part; 51—elbow pad; 52—first support pipe; 53—second support pipe; 54—third sliding sleeve; 55—third control knob; 56—second pin; 57—fourth control knob; 58—leg extension part.

DESCRIPTION OF THE EMBODIMENTS

The present disclosure will be described in detail below with reference to the drawings and in conjunction with embodiments. The various examples are provided by way of explanation of the present disclosure rather than limitation to the present disclosure. Indeed, it will be apparent to those skilled in the art that modifications and variations may be made in the present disclosure without departing from the scope or spirit of the present disclosure. For example, features shown or described as part of one embodiment may be used in another embodiment to produce yet another embodiment. It is therefore desirable that the present disclosure encompass such modifications and variations that fall within the scope of the appended claims and their equivalents.

In the description of the present disclosure, the terms "longitudinal", "transverse", "up", "down", "front", "back", "left", "right", "vertical", "horizontal", "top", "bottom" and the like denote orientation or positional relationships based on those shown in the drawings and are merely intended to describe the present disclosure conveniently rather than requiring that the present disclosure must be constructed and operated in a particular orientation, and therefore, they cannot be construed as limitations to the present disclosure. The terms "joint", "connect" and "set" used in the present disclosure should be understood in a broad sense, for example, which may refer to a fixed connection or a detachable connection; which may refer to a direct connection or an indirect connection through intermediate components; which may refer to a wired electrical connection, a radio connection, or a wireless communication signal connection, and the specific meanings of the above terms may be understood by those of ordinary skill in the art according to a specific situation.

One or more examples of the present disclosure are shown in the drawings. The detailed description uses numeric and alphabetic designations to refer to features in the drawings. Similar or like reference designations in the drawings and descriptions have been used to refer to similar or like parts of the present disclosure. As used herein, the terms "first", "second" and "third" and the like are used interchangeably to distinguish one member from another and are not intended to denote the location or importance of individual members.

As shown in FIGS. 1 to 6, according to the embodiments of the present disclosure, provided is a dumbbell bench, including a front leg part 1 and a rear leg part 2, where the front leg part 1 is hinged with the rear leg part 2 in a limited manner, the front leg part 1 is provided with a cushion part 3 and an elbow pad part 5 in a limited hinging manner, and the cushion part 3 and the elbow pad part 5 may rotate relative to the front leg part 1 at a limited angle, respectively; and the rear leg part 2 is provided with a backrest part 4 in a limited hinging manner, and the backrest part 4 may rotate relative to the rear leg part 2 at a limited angle.

Specifically, the front leg part 1 includes a front leg pipe 11, one end of the front leg pipe 11 is welded with a first connecting piece 12, and the first connecting piece 12 is provided with first connecting holes 121 and second connecting holes 122 penetrating through two sides thereof. The rear leg part 2 includes a rear leg pipe 21, one end of the rear leg pipe 21 is fixedly welded with a second connecting piece 22, and places, corresponding to the first connecting holes 121 and the second connecting holes 122 of the first connecting piece 12, of the second connecting piece 22 are provided with third connecting holes 221 and fourth connecting holes 222 respectively. The front leg part 1 further includes a bolt 14 and a first pin 15, and the second connecting piece 22 is inserted into the first connecting piece 12; after the first connecting holes 121 are corresponded to the third connecting holes 221 and the second connecting holes 122 are made to correspond to the fourth connecting holes 222, the bolt 14 penetrates through the first connecting holes 121 and the third connecting holes 221 sequentially, and the first pin 15 penetrates through the second connecting holes 122 and the fourth connecting holes 222 sequentially, and in this case, the first connecting piece 12 and the second connecting piece 22 are fixed through two points, and thus may not perform relative rotation; if the first connecting piece 12 needs to rotate relative to the second connecting piece 22, the first pin 15 may be pulled out, so that the first connecting piece 12 and the second connecting piece 22 are in a hinged connection, and can perform relative rotation. The first connecting piece 12 is further fixedly provided with a folding locating rod 123, a place, corresponding to the folding locating rod 123, of the second connecting piece 22 is provided with a folding locating slot 223, and sizes of the folding locating slot 223 and the folding locating rod 123 fit each other; and when the folding locating rod 123 is located in the folding locating slot 223, the first connecting piece 12 may not rotate upwards relative to the second connecting piece 22.

The other end of the front leg pipe 11 is provided with a front leg-foot pipe 13, the other end of the rear leg pipe 21 is provided with a rear leg-foot pipe 23; and the front leg-foot pipe 13 and the rear leg-foot pipe 23 are of a T-shaped structure, and configured to increase a contact area when the dumbbell bench touches the ground, so as to ensure supporting stability during use. The front leg-foot pipe 13 is detachably connected to the front leg pipe 11 through bolts, and the rear leg-foot pipe 23 is detachably connected to the rear leg pipe 12 through bolts.

The first connecting piece 12 is further fixedly provided with a cushion connecting rod 124 configured to be hinged with the cushion part 3. The cushion part 3 includes a cushion 31, a bottom part of the cushion 31 is detachably provided with two cushion pipes 35, end parts of the cushion pipes 35 are fixedly provided with cushion rotating casings 36, an inner diameter of each of the cushion rotating casings 36 fits an outer diameter of the cushion connecting rod 124, and the two cushion pipes 35 are hinged with the cushion connecting rod 124 through the cushion rotating casings 36. The cushion part 3 further includes a cushion support pipe 32, one end of the cushion support pipe 32 is hinged with the two cushion pipes 35, and the other end thereof is hinged with a first sliding sleeve 33; the first sliding sleeve 33 is sleeved on the front leg pipe 11 and may slide thereon; and during installation, the front leg-foot pipe 13 is removed, and then the first sliding sleeve 33 is sleeved from a lower end of the front leg pipe 11. The first sliding sleeve 33 is further provided with a first control knob 34; when the first control knob 34 is tightened, the first sliding sleeve 33 may be fixed on the front leg pipe 11 to avoid sliding, so that a stable triangular support structure is formed among the cushion support pipe 32, the front leg pipe 11 and the cushion pipe 35 to stably support the cushion 31; when an angle of the cushion 31 needs to be adjusted and after the first control knob 34 is unscrewed, the cushion 31 may rotate accordingly as the first sliding sleeve 33 is moved, and then the first control knob 34 is tightened again to complete the adjustment of the angle of the cushion 31 for use.

The second connecting piece 22 is further fixedly provided with a backrest connecting rod 224 configured to be hinged with the backrest part 4. The backrest part 4 includes a backrest 41, a bottom part of the backrest 41 is detachably provided with two backrest pipes 45, end parts of the backrest pipes 45 are fixedly provided with backrest rotating casings 46, an inner diameter of each of the backrest rotating casings 46 fits an outer diameter of the backrest connecting rod 224, and the two backrest pipes 45 are hinged with the backrest connecting rod 224 through the backrest rotating casings 46. The backrest part 4 further includes a backrest support pipe 42, one end of the backrest support pipe 42 is hinged with the two backrest pipes 45, and the other end thereof is hinged with a second sliding sleeve 43; the second sliding sleeve 43 is sleeved on the rear leg pipe 21 and may slide thereon; and during installation, the rear leg-foot pipe 23 is removed, and then the second sliding sleeve 43 is sleeved from a lower end of the rear leg pipe 21. The second sliding sleeve 43 is further provided with a second control knob 44; when the second control knob 44 is tightened, the second sliding sleeve 43 may be fixed on the rear leg pipe 21 to avoid sliding, so that a stable triangular support structure is formed among the backrest support pipe 42, the rear leg pipe 21 and the backrest pipe 45 to stably support the backrest 41; if an angle of the backrest 41 needs to be adjusted and after the second control knob 44 is unscrewed, the backrest 41 may rotate accordingly as the second sliding sleeve 43 is moved, and then the second control knob 44 is tightened again to complete the adjustment of the angle of the backrest 41 for use.

The elbow pad part 5 includes an elbow pad 51, a first support pipe 52 is fixedly arranged below the elbow pad 51 and is a telescopic pipe, a telescopic end of the first support pipe 52 is fixedly connected to a bottom part of the elbow pad 51, and a height of the elbow pad 51 is adjusted with an extension of the telescopic end of the first support pipe 52; the other end of the first support pipe 52 is hinged with a front leg-foot pipe 13 at a bottom end of the front leg pipe 11; one end of the second support pipe 53 is hinged with one side of a middle section of the first support pipe 52, and the other end thereof is hinged with a third sliding sleeve 54; the third sliding sleeve 54 further provided with a third control knob 55 is sleeved on the front leg pipe 11; when the third control knob 55 is tightened, the third sliding sleeve 54 is fixed on the front leg pipe 11 to avoid sliding, so that a stable triangular support structure is formed to stably support the elbow pad 51 among the first support pipe 52, the front leg pipe 11 and the second support pipe 53; and when an angle of the elbow pad 51 needs to be adjusted and after the third control knob 55 is unscrewed, the elbow pad 51 may rotate accordingly as the third sliding sleeve 54 is moved, and then the third control knob 55 is tightened to complete the adjustment of the angle of the elbow pad 51 *m* for use.

The front leg pipe 11 and the rear leg pipe 21 are provided with a plurality of locating holes, respectively, and apertures of the locating holes fit bolts of the first control knob 34, the second control knob 44 and the third control knob 55, so that all the control knobs are fixedly and stably connected to the front leg pipe 11 and the rear leg pipe 21, respectively.

Figure 4:
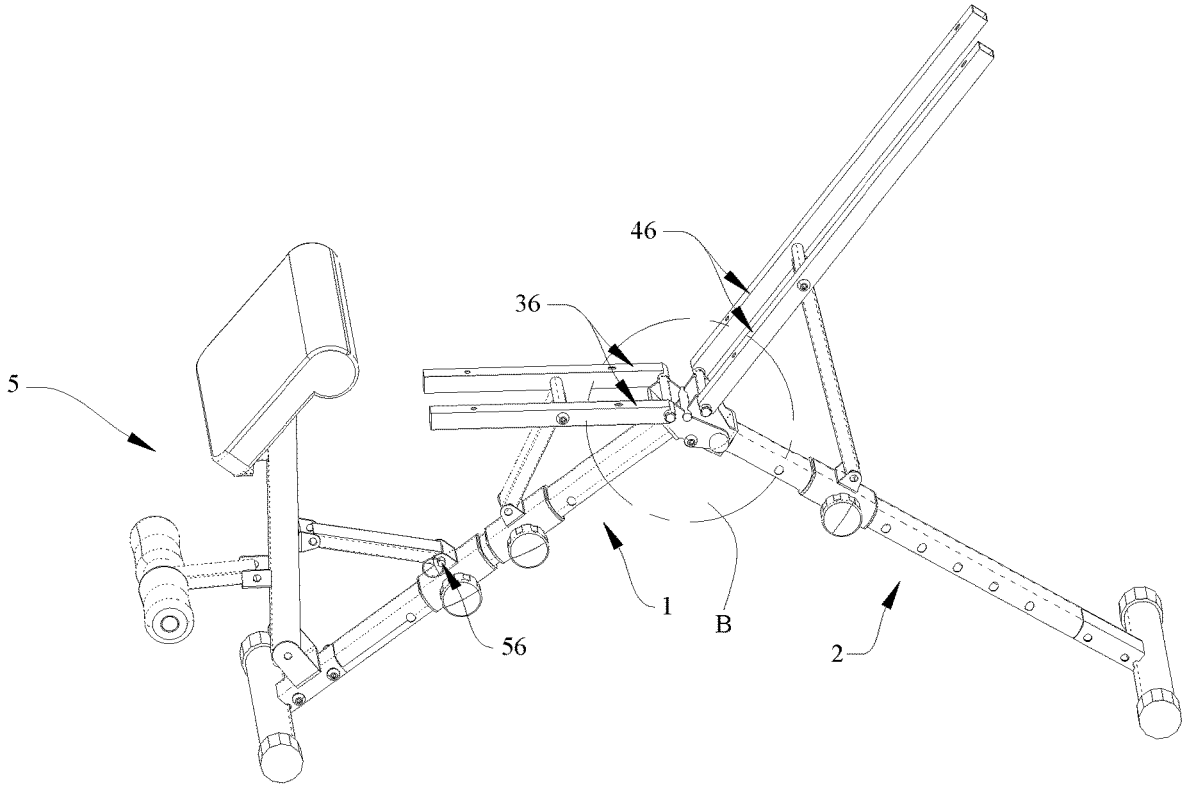
FIG. 4 is a structural schematic diagram of a cushion and a backrest removed from a dumbbell bench in an embodiment.
Figure 5:
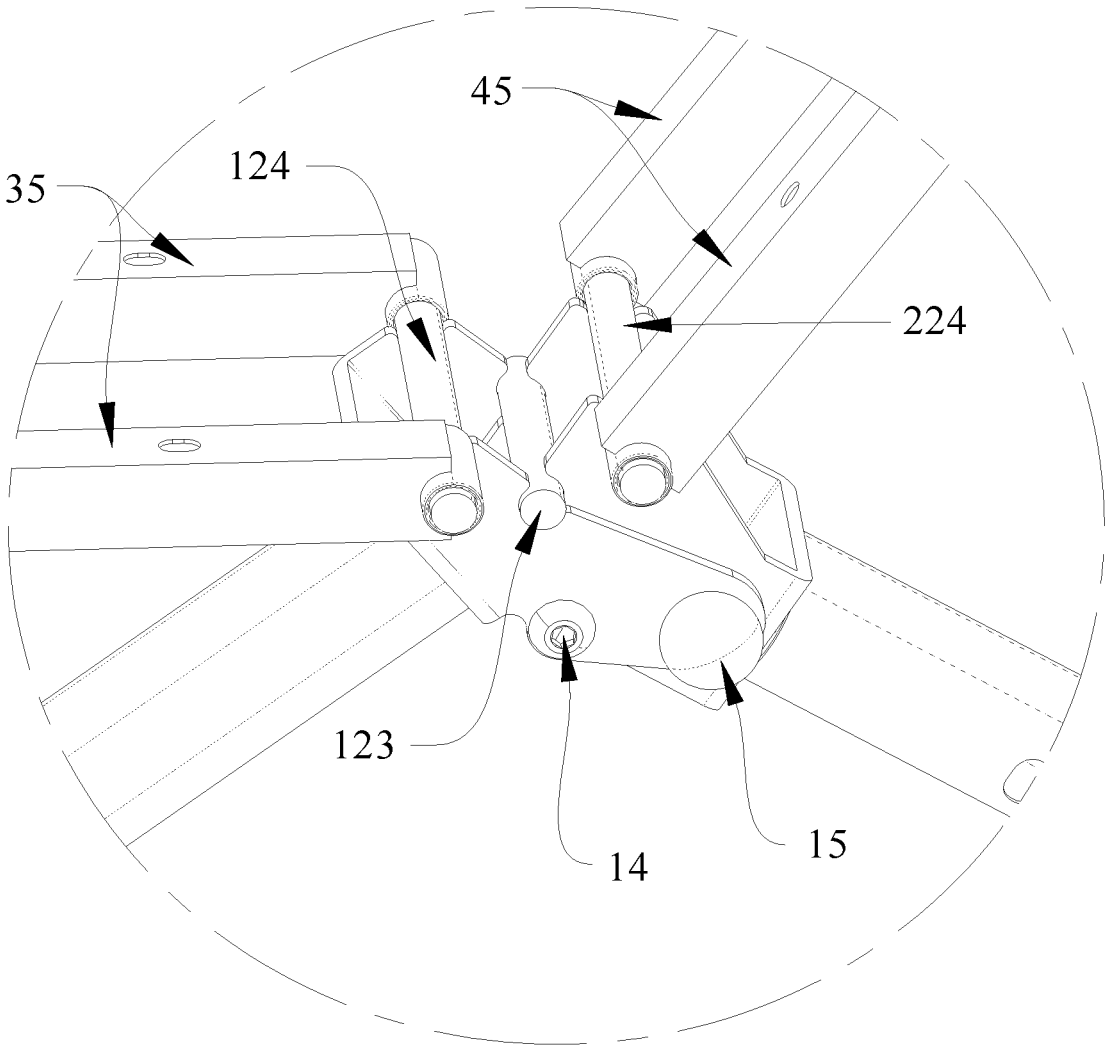
FIG. 5 is a structural enlarged view of a marked part at point B in FIG. 4.

As shown in FIG. 4, when the elbow pad 51 and the cushion 31 are folded to the front leg pipe 11 at the same time, the first sliding sleeve 33 slides in a direction opposite to the third sliding sleeve 54; and due to a limited length of the front leg pipe 11, the elbow pad part 5 and the cushion part 3 cannot be folded at the same time only by virtue of sliding the sliding sleeves. Further, a hinge between the second support pipe 53 and the third sliding sleeve 54 is provided with a second pin 56; the second support pipe 53 may be disconnected from the third sliding sleeve 54 by extracting the second pin 56, which facilitates folding of the elbow pad part 5. The second pin 56 may also be arranged at a hinge between the first support pipe 52 and the second support pipe 53, which may solve the foregoing problem as well.

The first support pipe 52 is further provided with a fourth control knob 57 configured to control locking of the elongated first support pipe 52, so that a height of the elbow pad 51 is adjusted conveniently.

One side, relative to the second support pipe 53, of the first support pipe 52 is hinged with a leg extension part 58 which may be folded upwards.

Figure 6:
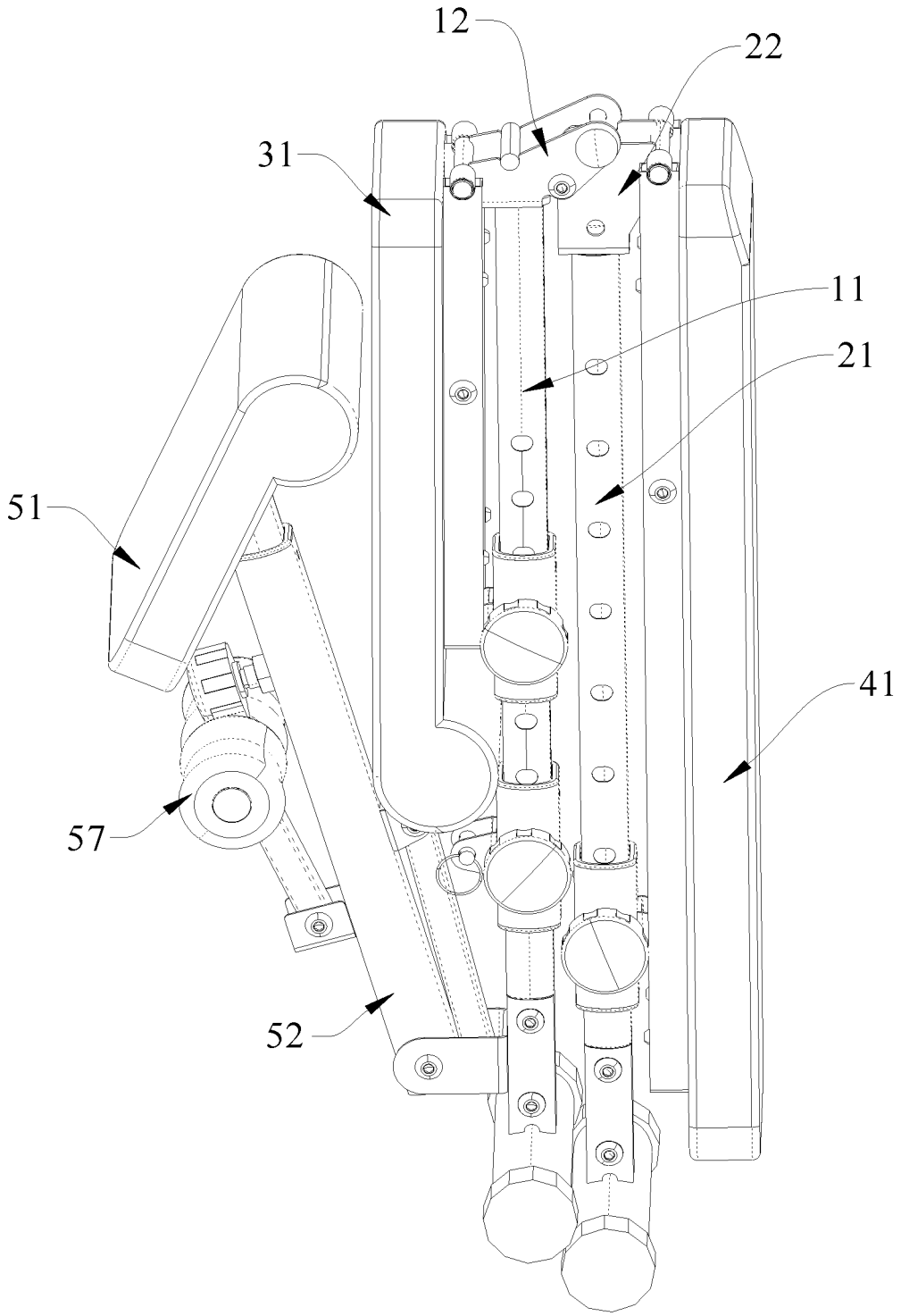
FIG. 6 is a structural schematic diagram of a folded dumbbell bench in an embodiment.

When the dumbbell bench is folded, the first control knob 34 and the second control knob 44 are unscrewed first, the first sliding sleeve 33 and the second sliding sleeve 43 are moved so that the cushion support pipe 32 and the cushion pipe 35 are parallel to the front leg pipe 11, respectively, and the backrest support pipe 42 and the backrest pipes 45 are parallel to the rear leg pipe 21, respectively; then the first pin 15 is pulled out, the front leg pipe 11 and the rear leg pipe 21 are rotated in an opposite direction so that the front leg pipe 11 and the rear leg pipe 21 are parallel; and finally, the second pin 56 is pulled out, the second support pipe 53 and the first support pipe 52 are folded to be parallel, the leg extension part 58 is folded toward the first support pipe 52, and the folded elbow pad part 5 is folded toward the front leg part 1. The folded dumbbell bench is shown in FIG. 6.

From the above description, it can be seen that the above embodiment of the present disclosure achieves the following technical effects:

1. For the foldable dumbbell bench with the elbow pad part 5, the cushion part 3, the backrest part 4 and the elbow pad part 5 may be folded, so that the folded dumbbell bench can be stored conveniently due to a small volume thereof.

2. The first pin 15 is arranged between the first connecting piece 12 and the second connecting piece 22, so that a usage state is locked by the first pin 15.

3. The first connecting piece 12 is provided with the first connecting piece 123, and the second connecting piece 22 is provided with the folding locating slot 223, so that the front leg part 1 and the rear leg part 2 in the usage state are located by the fit between the folding locating rod 123 and the folding locating slot 223, which facilitates mounting of the first pin 15.

4. The hinge of the second support pipe 53 is provided with the second pin 56, so that the second support pipe 53 may be folded after the second pin 56 is pulled out, which solves the problem that the elbow pad part 5 and the cushion part 3 cannot be supported when they are folded at the same time due to the limited length of the front leg pipe 11.

Compared with the prior art, the dumbbell bench disclosed by the present disclosure includes the cushion part, the backrest part and the elbow pad part that are all foldable. The volume of the dumbbell bench after being folded is reduced to facilitate storage, the folding structure is stable, and the folding and unfolding processes are convenient and quick.

The foregoing is merely a preferred embodiment of the present disclosure and is not intended to limit the present disclosure, and various modifications and variations thereof may be made by those skilled in the art. Any modification, equivalent replacement, improvement, etc. made within the spirit and principles of the present disclosure should be included in the scope of protection of the present disclosure.

What is claimed is:

1. A dumbbell bench, comprising a front leg part and a rear leg part, wherein the front leg part is hinged with the rear leg part in a limited manner, the front leg part is provided with a cushion part and an elbow pad part in a limited hinging manner, and the cushion part and the elbow pad part are configured to rotate relative to the front leg part at a limited angle, respectively; and the rear leg part is provided with a backrest part in a limited hinging manner, and the backrest part is configured to rotate relative to the rear leg part at a limited angle;

wherein the front leg part comprises a front leg pipe, one end of the front leg pipe is fixedly connected to a first connecting piece, the rear leg part comprises a rear leg pipe, one end of the rear leg pipe is fixedly connected to a second connecting piece; and the first connecting piece is further fixedly provided with a folding locating rod, a place, corresponding to the folding locating rod, of the second connecting piece is provided with a folding locating slot, and the folding locating rod is sized to fit within the folding locating slot; when the folding locating rod is located in the folding locating slot, the first connecting piece is not capable of rotating upwards relative to the second connecting piece.

2. The dumbbell bench according to claim 1, wherein the first connecting piece is provided with first connecting holes and second connecting holes penetrating through two sides thereof;

the second connecting piece is provided with third connecting holes and fourth connecting holes;

a bolt respectively penetrates through the first connecting holes and the third connecting holes to enable hinging between the first connecting piece and the second connecting piece; and a first pin respectively penetrates through the second connecting holes and the fourth connecting holes to enable limited locking between the first connecting piece and the second connecting piece.

3. The dumbbell bench according to claim 2, wherein the elbow pad part comprises an elbow pad, a first support pipe is fixedly arranged below the elbow pad, and another end of the first support pipe is hinged with a bottom end of the front leg pipe.

4. The dumbbell bench according to claim 3, wherein the elbow pad part further comprises a second support pipe, one end of the second support pipe is hinged with the first support pipe, and another end of the second support pipe is hinged with a third sliding sleeve; the third sliding sleeve is sleeved on the front leg pipe and is further provided with a third control knob; and when the third control knob is tightened, the third sliding sleeve is configured to be fixed on the front leg pipe to avoid sliding.

5. The dumbbell bench according to claim 4, wherein at least one of hinges of two end parts of the second support pipe is provided with a second pin.

6. The dumbbell bench according to claim 3, wherein a leg extension part is hinged on the first support pipe in a limited manner.

7. The dumbbell bench according to claim 3, wherein the first support pipe is a telescopic pipe, a telescopic end of the first support pipe is fixedly connected to a bottom part of the elbow pad, and a height of the elbow pad is adjusted with an extension of the telescopic end of the first support pipe.

8. The dumbbell bench according to claim 2, wherein the first connecting piece is further fixedly provided with a cushion connecting rod;

the cushion part comprises a cushion, a bottom part of the cushion is detachably provided with cushion pipes, end parts of the cushion pipes are fixedly provided with cushion rotating casings which are sleeved on the cushion connecting rod, and the cushion pipes are hinged with the cushion connecting rod through the cushion rotating casings.

9. The dumbbell bench according to claim 2, wherein the second connecting piece is further fixedly provided with a backrest connecting rod;

the backrest part comprises a backrest, a bottom part of the backrest is detachably provided with backrest pipes, end parts of the backrest pipes are fixedly provided with backrest rotating casings which are sleeved on the backrest connecting rod, and the backrest pipes are hinged with the backrest connecting rod through the backrest rotating casings.

10. The dumbbell bench according to claim 2, wherein another end of the front leg pipe is detachably provided with a front leg-foot pipe, and a bottom end of the elbow pad part is hinged with the front leg-foot pipe.

11. A dumbbell bench, comprising a front leg part and a rear leg part, wherein the front leg part is hinged with the rear leg part in a limited manner, the front leg part is provided with a cushion part and an elbow pad part in a limited hinging manner, and the cushion part and the elbow pad part is configured to rotate relative to the front leg part at a limited angle, respectively; and the rear leg part is provided with a backrest part in a limited hinging manner, and the backrest part is configured to rotate relative to the rear leg part at a limited angle;

the front leg part comprises a front leg pipe;

the elbow pad part comprises an elbow pad, a first support pipe is fixedly arranged below the elbow pad, and another end of the first support pipe is hinged with a bottom end of the front leg pipe; and the elbow pad part further comprises a second support pipe, one end of the second support pipe is hinged with the first support pipe, and another end of the second support pipe is hinged with a third sliding sleeve; the third sliding sleeve is sleeved on the front leg pipe and is further provided with a third control knob; and when the third control knob is tightened, the third sliding sleeve is configured to be fixed on the front leg pipe to avoid sliding.

* * * * *